United States Patent [19]

Malburg

[11] 4,231,283

[45] Nov. 4, 1980

[54] PULSATING LIQUID JET GUN AND METHOD OF OPERATING THE SAME

[75] Inventor: Werner Malburg, Ottobrunn, Fed. Rep. of Germany

[73] Assignee: Messerschmitt-Bölkow-Blohm Gesellschaft mit beschränkter Haftung, Fed. Rep. of Germany

[21] Appl. No.: 956,804

[22] Filed: Nov. 1, 1978

[51] Int. Cl.[3] ..... B05B 1/08; B05B 3/14

[52] U.S. Cl. ..... 89/8; 175/67; 239/101

[58] Field of Search ..... 89/8, 7, 1 B, 1 R; 175/67, 65, 422; 239/102, 101

[56] References Cited

U.S. PATENT DOCUMENTS

| | | | |
|---|---|---|---|
| 3,412,554 | 11/1968 | Voitsekhovsky et al. | 89/8 UX |
| 3,490,696 | 1/1970 | Cooley | 239/101 |
| 3,520,477 | 7/1970 | Cooley | 239/101 |
| 3,521,820 | 7/1970 | Cooley | 89/8 X |
| 3,539,104 | 11/1970 | Cooley | 239/102 |
| 3,784,103 | 1/1974 | Cooley | 175/67 X |
| 3,841,559 | 10/1974 | Hall et al. | 239/101 |
| 4,058,256 | 11/1977 | Hobson et al. | 239/101 |
| 4,074,858 | 2/1978 | Burns et al. | 239/101 X |

*Primary Examiner*—David H. Brown
*Attorney, Agent, or Firm*—McGlew and Tuttle

[57] ABSTRACT

A pulsating liquid jet gun, comprises, a housing which defines a cylinderbore having a small diameter portion defining a liquid chamber with an outer end having a discharge nozzle and an inner end which is connected to an intermediate diameter portion of a greater diameter than the smaller diameter portion and it, in turn, is connected at its opposite end to a large diameter portion. A free piston has a first portion which is movable in the intermediate diameter portion and a second portion of small diameter in the first portion which is movable in the small diameter portion of the bore in sealing engagement therewith. An ignition piston has a first portion which is movable in the large diameter portion and a second portion of a smaller diameter which is movable in the large diameter portion and into and out of this intermediate diameter portion. The second portion of the ignition piston and the first portion of the free piston have opposed end faces in the intermediate diameter portion which define a combustion space therebetween. A mechanism is provided for periodically delivering a charge of liquid into the small diameter portion and, in addition, a mechanism is provided for periodically delivering apropellant charge to the combustion space and to cause the ignition of the propellant charge to generate hot reaction gases between the ignition piston and the free piston so as to cause relative displacement therebetween in respective opposite directions and to cause the expulsion of the liquid instantaneously through the nozzle under high force.

25 Claims, 4 Drawing Figures

PULSATING LIQUID JET GUN AND METHOD OF OPERATING THE SAME

FIELD AND BACKGROUND OF THE INVENTION

This invention relates to high velocity liquid discharge devices in general and, in particular, to a new and useful liquid jet discharging method and to a pulsating liquid jet gun, comprising a free piston which is movable in a cylinder bore between a combustion space and a liquid chamber and which is driven during the working stroke by the hot reaction gases of a propellant charge which is periodically ignited in the combusion space, and actuates a definite amount of liquid, thereby, producing a high speed liquid jet, with the liquid being refilled into the liquid chamber prior to every ignition of the propellant.

With pulsating water guns of the prior art, in order to increase the pressure, the free piston is usually designed as a differential pressure piston. The propellant gas reaction is initiated, in accordance with the Otto principle, by an electrical spark plug or a pyrotechnic primer composition and propagates outwardly starting from the point of initiation. In order to attain the safe high pressure refilling of the liquid chamber, this design requires a highly expensive construction and control for the operation of the free piston.

Such devices have the further drawback that the retarded building-up of pressure in the combustion space adversely affects the maximum obtainable pressures or pressure increase rates and, thereby, also the shot effect of the liquid jet, and this is true, even if high energy monergolic or non-hypergolic propellant systems in the form of one or more separate liquid propellant components, for example, are used.

SUMMARY OF THE INVENTION

The present invention is directed to a pulsating liquid jet gun which is substantially more efficient and, at the same time, is simpler in construction and more reliable in operation, and to a method of operating such a liquid jet gun.

In accordance with the invention, a pulsating liquid jet gun is provided in which the propellant charge in the combustion space is ignited by an adiabatic compression thermally initiating the ignition.

In the inventive liquid jet gun, the entire amount of propellant needed for one working cycle of the free piston is first fed into the combustion space and the gaseous portion of the propellant charge, consisting of a gaseous propellant component and/or a separate gas not participating in the propellant reaction, is then adiabatically compressed up to a thermal ignition of the propellant, so that the entire amount of propellant reacts suddenly at one blow. This, in contradistinction to the course of reaction on the Otto or Diesel principles, advantageously results in a short pressure surge having an extremely steep slope and amplitude by which the limited amount of liquid is expelled from the liquid chamber shot-like in the form of a water projectile having an enormous disruptive effect. The efficiency of the pulsating liquid jet gun is thereby increased considerably in a simple manner.

According to a feature of the invention, the propellant which is fed into the combustion space preferably contains one or more separate liquid propellant components and a gaseous component, for example, oxygen, whose adiabatic compression initiates the ignition of the propellant and supports the reaction as an ignition stimulant. Either selectively, or in addition, a separate gas, for example, a residual amount of reaction gas which has not been expelled from the combustion space, may be used as the gaseous portion of the propellant charge to be adiabatically compressed to initiate the ignition.

In a particularly advantageous embodiment of the invention, a separate ignition piston is provided in addition to the free piston, by which the propellant charge in the combustion space is adiabatically compressed, while the free piston stands substantially still during the gas compression and, thus, cannot produce any undue suction effect in the liquid space, whereby, local vapor formation or cavitation in the liquid chamber which could otherwise, if at all, be suppressed only at great control expenses and would considerably affect the disruptive power of the pulsating gun, is effectively eliminated in a simple and secure manner and the operation of filling the liquid chamber is considerably simplified.

In this case, it is advisable to provide a closing of the propellant supply lines after the propellant charge has been fed into the combustion space and immediately prior to the propellant ignition, by the ignition piston itself, so that highly loaded propellant control valves, for example, check valves, which would be exposed to the high shock pressure in the combustion space can be omitted. For this purpose, one or more propellant supply ports opening into the combustion space are provided which are closed by the ignition piston during the compression stroke thereof.

Due to the features of another embodiment of the invention, a preferably hydraulic pressure fluid drive of the ignition piston during the compression stroke with a relatively low hydraulic pressure, relative to the compression, and correspondingly small loads on the valve system needed for the ignition piston control is obtained. In addition, a dynamic braking of the ignition piston at the end of the compression stroke is advantageously effected by a fluid cushion.

The return stroke of the ignition piston may be accomplished, in accordance with another feature of the invention, by loading the circular shoulder of the ignition piston with a fluid which then forms, at the same time, the fluid cushion braking the ignition piston at the end of the compression stroke. Either selectively or in addition, the return stroke may be accomplished by means of the free piston which acts on the ignition piston during its return stroke either directly, or through a gas cushion, and returns it into its initial position.

In order to fully utilize the pressure peak obtained by the quick and thorough reaction of the entire amount of propellant for the working stroke of the free piston, the ignition piston is hydraulically locked during the working stroke of the free piston. The locking is advantageously done in the simplest way by a check valve which automatically closes upon exceeding a predetermined pressure on the larger ignition piston surface exposable to pressure fluid, and which, after the pressure in the combustion space and thus also in the pressure fluid space, limited by the larger ignition piston surface, drops below a predetermined value, is reopened and, thereby, releases the ignition piston for its return motion.

In accordance with a further inventive feature, the return stroke of the ignition piston may also be accomplished, at least partly, by the action of the hot reaction gases during the working stroke of the free piston, in which case, the return motion of the ignition piston is dynamically braked, so that the high pressure peak in the combustion space, obtained by the adiabatic ignition of the propellant, is preserved to a large extent for the working stroke of the free piston.

The pure pressure fluid control of the piston motions described above has the further advantage that any mechanical locking or driving component parts which would cooperate with the pistons and be exposed to strong stresses during operation are omitted. A mechanical stop is provided only to limit the return motion of the ignition piston but it also serves the purpose of fixing the free piston in its position of full return. However, this stop is exposed to very small mechanical loads since the pistons are returned at a relatively low speed.

In order to obtain a particularly advantageously rugged construction, the two pistons are disposed coaxially with each other and in a common bore section forming the combustion space.

To enable the feeding of the propellant in a simple, manner at a substantially constant low pressure level, the invention includes the advantageous provision that the free piston is slightly advanced by the injected propellant amount and in the direction of the working stroke from its full return position in which it is applied, through the ignition piston, against the mechanical stop, into an initial position in which it is held during the quick compression stroke of the ignition piston up to the instant of the adiabatic propellant ignition, preferably by its own inertia or, if necessary, by an additional hydraulic locking. Due to this advantageous design, a pure pressure fluid control of the free piston is also obtained, except for the provision of the mechanical stop fixing the piston in its full return position. According to further features of the invention, the impact pressure transmitted from the combustion space through the free piston to the limited amount of liquid to be ejected is considerably increased, in proportion to the piston surface ratio of the free piston.

In a particularly advantageous manner, the operating liquid flows into the return space of the free piston. This return space in the position of full return of the free piston, is open in the direction of the liquid chamber, so that this chamber can be filled with operating liquid from the return space. Upon the advance of the free piston from its position of full return into its initial position, and thus still prior to the adiabatic propellant ignition, this flow communication between the return space and the liquid chamber is shut off by the smaller portion of the free piston, and the strong pressure impact in the combustion space becomes effective in the liquid chamber. This substantially simplifies the technique of filling the liquid chamber and, at the same time, the free piston is cooled by the liquid flowing through the return space.

A particularly simple construction of the flow communication between the return space and the liquid chamber is provided, which, at the same time, ensures that the smaller portion of the free piston is permanently guided in the bore section forming the liquid chamber of the cylinder bore. Due to the continuous flow of liquid through the return space, in accordance with a feature of the invention, no separate control valves are needed for returning the free piston and filling the liquid chamber and the cooling of the free piston is improved at the same time.

Accordingly, an object of the invention is to provide a pulsating liquid jet gun which comprises a free piston which is movable in a cylinder bore between a combustion space and a liquid chamber and is driven, during the working stroke, by hot reaction gases of a propellant charge which is periodically ignited in the combustion space and actuates a definite amount of liquid, thereby, producing a high speed liquid jet, with the liquid being refilled into the liquid chamber prior to every ignition of the propellant and the propellant charge in the combustion chamber being ignited by an adiabatic compression thermally initiating the ignition.

A further object of the present invention is to provide a pulsating liquid jet gun which comprises a housing defining a cylinder bore, having a small diameter portion defining a liquid chamber, with an outer end having a discharge nozzle and an inner end, and with an intermediate diameter portion of a greater diameter than the small diameter portion, connected to the inner end of the small diameter portion, and with a large diameter portion of a greater diameter than said intermediate diameter portion, said gun further including a free piston having a first portion movable in the intermediate diameter portion and a second portion of a smaller diameter than the first portion movable in the intermediate diameter portion and also into the small diameter portion and with an ignition piston which has a first portion movable in the large diameter portion and having a second portion of a smaller diameter than the first portion which is movable in the large diameter portion and also into the intermediate diameter portion and, wherein, the free piston and the ignition piston have opposed end faces in the intermediate diameter portion which define a combustion space therebetween, and further including means for periodically delivering a charge of liquid into said small diameter portion and means for periodically delivering a propellant charge to said combustion space and to ignite the propellant charge to generate hot reaction gases to cause movement of said free piston and said ignition piston in respective opposite directions and to cause the liquid to be displaced out of said small diameter portion and through said nozzle.

Another object of the invention is to provide a method of operating a pulsating liquid jet gun using a cylinder having an interconnected large diameter portion, an intermediate diameter portion and a small diameter portion of different diameter dimensions with the smallest diameter portion having a nozzle discharge, and using an ignition piston having respective portions movable in the large diameter portion and into the intermediate diameter portion and in sealing engagement therewith and a free piston having respective portions movable in the intermediate diameter portion and into and out of the small diameter portion in sealing engagement therewith which comprises, periodically directing a propellant charge into the intermediate diameter portion between the free piston and the ignition piston, and periodically filling the small diameter portion with liquid and igniting the propellant charge in the space between the free piston and the ignition piston to cause movement of the free piston second portion through the small diameter cylinder bore to discharge the water through said nozzle.

A further object of the present invention is to provide a pulsating liquid jet gun which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
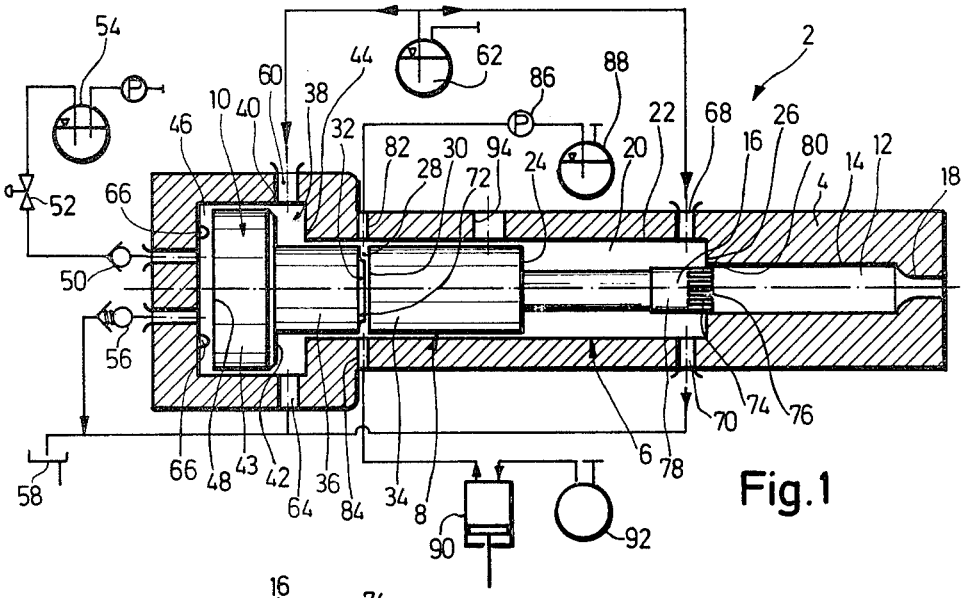
FIG. 1 is a diagrammatical, longitudinal, sectional view of a pulsating liquid jet gun, constructed in accordance with the invention, and comprising a preferred embodiment of the invention.

Referring to the drawings in particular, the invention embodied therein, comprises, a pulsating liquid jet gun for use in generating high force and velocity charges of liquid jets which may be directed against a target for the purpose of wearing away the surface thereof, for example.

Figure 2:
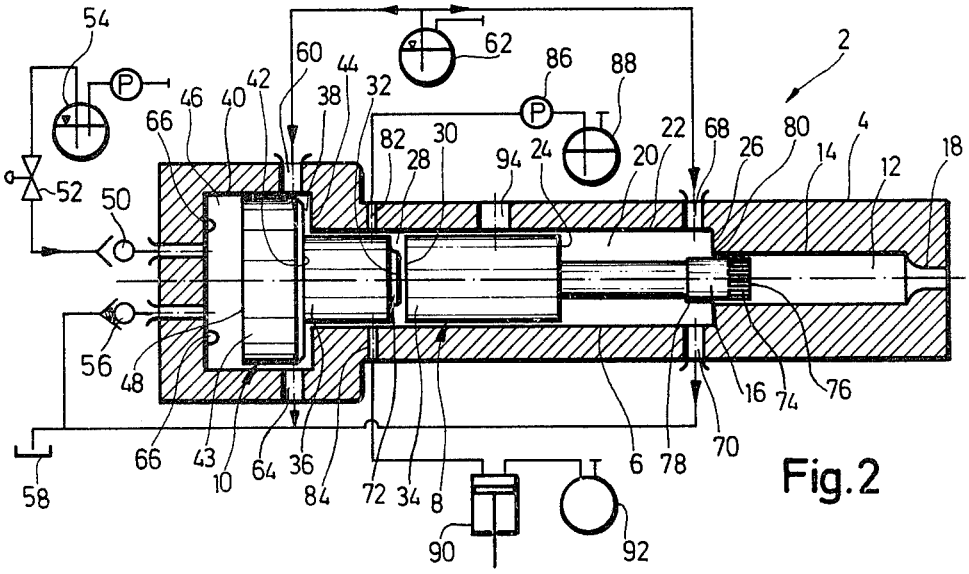
FIG. 2 is a view, similar to FIG. 1, showing the parts in a position after the compression of the propellant charge and prior to the working stroke of the free piston.

According to FIGS. 1 and 2, the pulsating liquid jet gun 2 comprises, as substantial parts, a high pressure cylinder 4, having a stepped inside bore 6 in which a free piston 8, designed as a differential pressure piston, and an ignition piston 10 coaxial therewith, and also designed as a differential pressure piston, are received for displacement. The inside bore 6 is divided by the pistons 8 and 10 into a plurality of chambers or spaces which are sealed relative to each other, namely, a liquid chamber 12 limited by a narrowest bore portion 14 of inside bore 6 and by a smaller piston portion 16 of free piston 8. The operating liquid is instantaneously expelled through a jet nozzle 18 during the working stroke of free piston 8 and in the form of a high speed liquid jet.

A return space 20 is defined in an intermediate portion 22 of the inside bore 6, between a circular shoulder 24 of free piston 8 and a circular surface 26 limiting the intermediate portion 22 of the bore. A combustion space 28, having a varying volume, extends between the facing end faces or piston surfaces 30 and 32 of the piston portions 34 and 36 of free piston 8 and ignition piston 10, respectively. Piston portions 34 and 36 are guided in the intermediate portion 22 of the bore. A low pressure space 38 extends in a widest bore portion 40 between a circular shoulder 42 of a larger portion 43 of ignition piston 10 and an opposite circular surface 44 of inside bore 6, and pressure space 46 is located at the end of the widest bore portion 40 limited by a larger piston end surface 48 of the ignition piston 8.

Pressure space 46 is connected, through a check valve 50 and a switchable control valve 52, to a pressurized water tank 54 with a medium pressure level, for example, of 120 bar, and is also connected to a low pressure zone 58 through a spring-loaded check valve 56, also opening in the direction of the pressure space 46, which automatically closes above a predetermined pressure in space 46, for example, a pressure of 60 bar.

Low pressure space 38 is permanently pressurized with water through an inlet bore 60 from a supply tank 62, where the pressure level is relatively low, for example, 10 bar, and communicates freely through an outlet bore 64 with the low pressure zone 58. By the relatively low water pressure acting in low pressure space 38 on circular shoulder 42 of ignition piston 10, this piston is continuously slightly biased in the direction of its full return position shown in FIG. 1 in which it is applied, by its larger piston surface 48 and through stops 66, against the pressure space end of inside bore 6.

The supply and exit bores 60 and 64 of low pressure space 38 are offset in the axial direction relative to annular surface 44, so that upon a quick compression stroke of ignition piston 10, and as the larger ignition piston portion 43 passes over bores 60 and 64, a water cushion is formed at the compression stroke end between annular shoulder 42 and annular surface 44, by which ignition piston 10 is progressively braked and a direct impingement of annular shoulder 42 against annular surface 44 is prevented.

In the same manner as low pressure space 38, return space 20 is also continuously pressurized with water through a supply bore 68 from the supply tank 62 with the water being drained through an outlet bore 70 to the low pressure zone 58. Bores 68 and 70 are also offset in the axial direction relative to the annular surface 26, so that at the end of the working stroke and upon passing of the free piston 8 over bores 68 and 70, it is progressively braked by a hydraulic cushion building up between annular shoulder 24 and surface 26.

FIG. 1 shows the pulsating water gun 2 in a position immediately prior to the injection of the propellant into combustion space 28. In this position, ignition piston 10, under the biasing pressure in low pressure space 38, is returned to apply against stops 66, and check valve 56 is held in an open position under the action of its spring, so that pressure space 46 is substantially pressureless. Free piston 8 is also in its full return position, with its return travel being caused by the continuous water pressure in return space 20 and limited by a projecting portion 72 of a smaller diameter provided on the ignition piston surface 32 facing the combustion space.

Figure 1A:
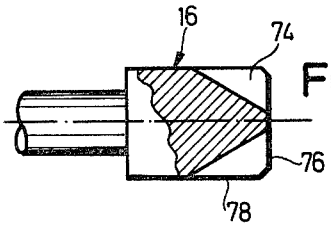
FIG. 1*a* is a partial, sectional view on an enlarged scale of the small diameter portion of the free piston shown in FIG. 1.

At that time, combustion space 28 is filled with a residual amount of reaction gas which has not been expelled at the end of the working stroke of free piston 8, and the smaller portion 16 of the free piston 8 is retracted from the smallest bore section 14 so far that liquid chamber 12 is filled with water from return space 20. For this purpose, smaller portion 16 of free piston 8 is provided with a plurality of circumferentially distributed filling channels 74 in the form of axially extending oblique slots which, as shown in FIG. 1*a*, extend between a front surface 76 and the surface of the cylindrical periphery of the smaller piston portion 16.

The channels 74 are retracted, in the full return position of free piston 8, shown in FIG. 1, so far behind a control edge 80 formed between annular surface 26 and the smallest bore section 14, that return space 20 communicates with liquid chamber 12 through filling channels 74. The smaller piston portion 16 is still guided in the smallest bore section 14 by the lands extending between the slots 74 on the periphery of its front portion. Thus, liquid chamber 12 is filled with water from supply tank 62 and through return space 20, while free piston 8 is in its position of full return, without a separate system of switching or control valves, with the water in excess being capable of escaping through the jet nozzle 18.

The propellant is supplied through inlet ports 82 and 84 which, during the full retraction of ignition piston 10, are not covered by the small portion 36 of the ignition piston. The ports 82 and 84 open into the combustion space 28 in the intermediate section 22 of the bore. Inlet port 82 is connected through a metering pump 86 to a propellant tank 88 which is filled with a monergolic liquid propellant, such as isopropyl nitrate, while inlet port 84 is connected through a piston pump 90 to a propellant component or gas tank 92, for example, an oxygen tank. Instead of a monergol, a non-hypergolic multicomponent liquid propellant may also be used.

Upon switching on the metering pump 86 and the piston pump 90, combustion space 28 is filled with a metered amount of liquid propellant from tank 88, and a metered amount of oxygen from gas tank 92. This causes the free piston 8 to advance a short distance corresponding to the filled amount of gas and liquid propellant, against the biasing pressure in the return space 20 and in the direction of liquid chamber 12, into an initial position for the working stroke, in which the control edge 80 has already passed over filling channels 74 of the small piston portion 16, so that liquid chamber 12 is separated from return space 20. This position of free piston 8 is shown in FIG. 2.

Thereupon, control valve 52 is opened, so that pressure water from medium pressure tank 54 flows into pressure space 46, whereby, check valve 56 is closed agaist the action of its spring and ignition piston 10 is quickly driven forward, into its compression position, shown in FIG. 2. Due to the compression stroke of ignition piston 10, the residual gas of former reaction gases and oxygen are adiabatically compressed, while free piston 8, due to its own inertia, initially remains substantially at a standstill.

The adiabatic compression increases the temperature in the combustion space to such an extent that the entire liquid propellant charge is thermally ignited and undergoes a thorough, abrupt reaction, with the oxygen acting as a sort of ignition stimulant accelerating the reaction. Since at the start of the compression stroke, inlet ports 82 and 84 become covered by the smaller portion 36 of ignition piston 10, a backflash of the propellant reaction into tanks 88, 92 is prevented. At the end of the compression stroke, as already mentioned, the ignition piston 10 is dynamically braked by a hydraulic cushion effective between shoulder 42 and surface 44, and the ignition piston stops in its position shown in FIG. 2.

The sudden propellant reaction in combustion space 28 causes a pressure wave with extremely steep sides and an extreme amplitude, reaching pressure values of 5000 to 7000 bar within few milliseconds. Under the impact of this pressure wave which propagates through free piston 8 into liquid chamber 12 under a pressure increase corresponding to the ratio of piston surfaces 30 and 76, the water amount received in the chamber 12 is suddenly expelled through jet nozzle 18, as the result of the working stroke of free piston 8 so that a water projectile of extreme speed is directed outwardly and serves, for example, the purpose of a hydraulic dislodging of rocks.

During the working stroke of free piston 8, ignition piston 10 is hydraulically locked by the check valves 50 and 56 until free piston 8 passes beyond an exhaust aperture 94, whereupon, the expanded reaction gas escapes from combustion space 28 which then becomes substantially pressureless. Since, in the meantime, control valve 52 has been closed, the pressure in pressure space 46 also drops to an extent such that check valve 56 opens under the action of its spring and ignition piston 10 is again moved into its position of full return, against stops 66, under the effect of the biasing pressure in low pressure space 38 (FIG. 1). In an analogous manner, free piston 8 is also moved back, due to the water pressure in return space 20, into its full return position, shown in FIG. 1, with a non-expelled residual amount of reaction gas remaining in combustion space 28. The liquid chamber 12 is then filled again with water through channels 74 and a new working cycle can begin.

In order to control switching valve 52 and pumps 86 and 90 in accordance with the working cycle of pistons 8 and 10, pressure sensors or mechanical or electrical switching elements (not shown), responsive to the pressure in inside bore 6 at a predetermined piston position, is advantageously provided. The metering of the propellant for each working cycle is dimensioned in a manner such that at the end of the working stroke, thus as shoulder 24 passes over bores 68 and 70, the entire kinetic energy of free piston 8 is consumed by the expulsion of the limited water amount from liquid chamber 12.

Figure 3:
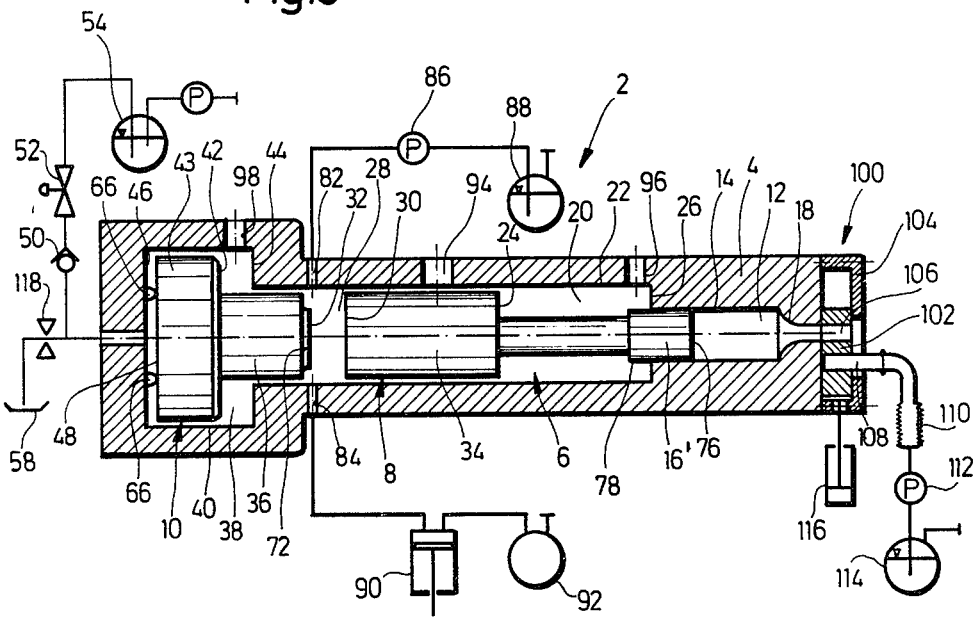
FIG. 3 is a diagrammatical, longitudinal, sectional view of another embodiment of the invention, showing the parts in a position after the propellant supply has been directed into the combustion space and prior to the compression stroke of the ignition piston.

FIG. 3 shows another embodiment of a pulsating liquid jet gun, the construction and operation of which corresponds substantially to that of the embodiment of FIGS. 1 and 2, and therefore, corresponding reference numerals are used in the embodiment of FIG. 3 also.

According to FIG. 3, in which the water gun 2 is shown in a position after the charging of combustion space 28 with liquid propellant from propellant tank 88 and with oxygen from gas tank 92 and thus right before the compression stroke of ignition piston 10, a continuous water pressure in spaces 20 and 38, which has been intended for returning pistons 8 and 10 into their starting positions, is omitted. Instead, these spaces are continuously open to the outer atmosphere through vent bores 96 and 98, which again are offset in the axial direction relative to circular surface 26 and 44, so that free piston 8 at the end of its working stroke, or ignition piston 10 at the end of its compression stroke, are now dynamically braked by a pneumatic fluid cushion which is effective between the respective piston shoulders 24, 42, and the corresponding annular surfaces 26, 44.

To fill the liquid chamber 12 under a simultaneous retraction of free piston 8 into its full return position, a shiftable filling mechanism 100 is provided at the nozzle end of the cylinder, comprising, a slide 102 which is received for transverse displacement in a cap 104 screwed to cylinder 4, and an eccentric passage bore 106 and a central bore 108 which is connected, through a flexible line 110 and a pump 112, to a water tank 114. A double-acting hydraulic motor 116 is provided for shifting slide 102.

Liquid chamber 12 is permanently separated from space 20 by a smaller portion 16' of free piston 8, and after the working cycle of free piston 8 during which the eccentric passage bore 106 of slide 102 is aligned with jet nozzle 18, the slide 102 is displaced by hydraulic motor 116, so that the central bore 108 now becomes aligned with jet nozzle 18 and liquid chamber 12 is filled, through flexible line 110 and pump 112, with low-pressure water from tank 114, where by, at the same time, free piston 8 is moved back into its full return position. Thereupon, hydraulic motor 116 is returned to its position shown in FIG. 3, so that during the following charging of combustion space 28 with the metered amount of propellant and oxygen, the free piston 8 advances into the initial working position shown in FIG. 3. Hydraulic motor 116 again is controlled by pressure sensors or position switches in accordance with the working cycle of free piston 8.

FIG. 3 further shows a slightly modified pressure fluid control for ignition piston 10, in which the check valve 56, according to FIGS. 1 and 2, is omitted and instead, pressure space 46 is continuously connected through a throttle 118 to low pressure zone 58. It is also possible, however, to control ignition piston 10 by the pressure fluid means, in accordance with FIGS. 1 and 2, including check valve 56, in which case, ignition piston 10 is moved into its full return position on stops 66 by the action of free piston 8 against the small piston surface 32 of the ignition piston during the back stroke, directly or through a residual gas cushion which has remained in combustion space 28.

According to FIG. 3, however, check valve 56 is replaced by the throttle 118 which is dimensioned so that upon opening control valve 52, only a small part of pressure water from medium pressure tank 54 passes into the low pressure zone 58, while the by far greater part flows into pressure space 46 and quickly drives piston 10 into its compression position. Under the pressure of the hot gases from the propellant reaction and upon closing control valve 52, ignition piston 10 is then returned into its full return position. This motion, however, is dynamically decelerated by throttle 118, so that the high pressure peak at the start of the working stroke of free piston 8 is only unsubstantially reduced by the braked return motion of ignition pistion 10. In the event ignition piston 10 fails to reach its full return position, upon the exhaustion of the reaction gases through exhaust 94, it is moved into the position shown in FIG. 3 by the return stroke of free piston 8, in the manner described above.

In the embodiment of FIG. 3, a certain return impact damping is obtained and, at least, the continuous water pressure in low pressure space 38 is omitted. However, liquid chamber 12 may be filled and free piston 8 may be returned selectively also in the same way as provided in the embodiment of FIGS. 1 and 2, with the omission of the filling mechanism 100.

While specific embodiments of the invention have been shown and described in detail to illustrate the application of the principles of the invention, it will be understood that the invention may be embodied otherwise without departing from such principles.

I claim:

1. A pulsating liquid jet gun, comprising, a cylinder having a cylinder bore with a combustion space for periodically receiving a propellant charge and a bore portion defining a liquid chamber, a free piston movable in said cylinder bore between said combustion space and said liquid chamber, means for generating hot reaction gases by ignition of said propellant charge periodically in said combustion space, means for filling liquid into said liquid chamber prior to every ignition of said propellant charge, said means for generating hot reaction gases for causing ignition of the propellant charge being by an adiabatic compression thereof thermally initiating the ignition.

2. A pulsating liquid jet gun, as claimed in claim 1, wherein said propellant charge in the combustion space comprises a propellant and a residual amount of reaction gases which have not been expelled from said combustion space.

3. A pulsating liquid jet gun, as claimed in claim 1, wherein said propellant contains at least one gaseous propellant component.

4. A pulsating liquid jet gun, as claimed in claim 1, wherein said propellant contains at least one liquid propellant component.

5. A pulsating liquid jet gun, as claimed in claim 1, wherein said means for generating hot gases includes an ignition piston movable in said cylinder bore and defining said combustion space with said free piston, said ignition piston being moved toward said free piston to cause the adiabatic compression of the propellant charge while the free piston is substantially still.

6. A pulsating liquid jet gun, as claimed in claim 5, wherein said means for generating hot reaction gases of a propellant charge includes an inlet port for directing a propellant charge into the space between said free piston and said ignition piston during the compression stroke of said ignition piston.

7. A pulsating liquid jet gun, as claimed in claim 6, wherein said ignition piston comprises a non-restrained differential pressure piston having a large diameter piston portion movable in a large diameter cylindrical bore portion of said cylinder and a smaller portion movable into the bore portion defining said combustion space, and including a pressure medium for driving said ignition piston acting on the large diameter portion thereof.

8. A pulsating liquid jet gun, as claimed in claim 7, including means establishing a fluid cushion in said large diameter portion of said cylinder acting on the large diameter portion of said ignition piston in each end position of its movement.

9. A pulsating liquid jet gun, comprising, a housing defining a cylinder bore having a small diameter portion defining a liquid chamber with an outer end having a discharge nozzle and an inner opposite end, an intermediate diameter portion of greater diameter than said small diameter portion connected to said opposite inner end, a large diameter portion of greater diameter than said intermediate diameter portion connected to said intermediate diameter portion, a free piston having a first portion movable in said intermediate diameter portion and a second portion of smaller diameter than said first portion moable in said intermediate diameter portion and also into said small diameter portion, an ignition piston having a first portion movable in said large diameter portion of said cylinder and a second portion of a smaller diameter than said first portion movable in said larger diameter portion of said cylinder and also into said intermediate diameter portion, said second portion of said ignition piston and said first portion of said free piston having opposed end faces in said intermediate portion which define a combustion space therebetween, means for periodically delivering a charge of liquid into said small diameter portion, means for periodically delivering a propellant charge to said combustion space, and means for acting on said ignition piston to move said ignition portion toward said free piston to produce hot reaction gases between said free piston and said ignition piston and causing adiabatic ignition of the propellant charge to cause movement of said free piston and said ignition piston in respective opposite relative directions to cause liquid to be displaced by said second portion of said free piston out of said nozzle.

10. A pulsating liquid jet gun, as claimed in claim 9, wherein said means for delivering a charge of liquid to said smaller diameter portion includes said means for acting on said ignition piston to displace said ignition piston to cause adiabatic ignition of said propellant.

11. A pulsating liquid jet gun, as claimed in claim 9, including means for delivering low pressure into the large diameter portion of said cylinder on the side of the large diameter portion of said ignition piston which is adjacent to said free piston, said large diameter portion of said cylinder between the inlet of the liquid and the end of said large diameter portion of said cylinder defining a fluid cushion thereon which is effective to brake said ignition piston.

12. A pulsating liquid jet gun, as claimed in claim 9, wherein said small diameter portion of said free piston includes a plurality of axially extending liquid channels, said means for delivering liquid to said small diameter portion including a connection to said intermediate diameter portion of said cylinder, said small diameter portion of said free piston being positioned in an end position so as to establish communication through said channels from said intermediate diameter portion of said cylinder to said small diameter portion of said cylinder.

13. A pulsating liquid jet gun, as claimed in claim 9, wherein said means for periodically delivering a charge of liquid to said liquid chamber includes a connection into said intermediate diameter portion of said cylinder so as to continuously pressurize this portion of said cylinder with liquid.

14. A pulsating liquid jet gun, as claimed in claim 9, wherein said intermediate portion of said cylinder defines a low pressure space between a wall bounding said intermediate portion of said cylinder and the adjacent face of said large diameter portion of said ignition piston and including means for continuously pressurizing said low pressure space with a fluid for effecting the return stroke of said ignition piston.

15. A pulsating liquid jet gun, as claimed in claim 14, wherein said ignition piston includes a projecting end surface facing said free piston, said free piston acting on said end surface to return said ignition piston after discharging liquid from said nozzle.

16. A pulsating liquid jet gun, as claimed in claim 15, including means for hydraulically locking said ignition piston in position during the working stroke of said free piston.

17. A pulsating liquid jet gun, as claimed in claim 15, wherein said ignition piston is returned from its compression position by the action of the hot reaction gases which are generated and means for providing a dynamic braking of said ignition piston during its return stroke.

18. A pulsating liquid jet gun, as claimed in claim 15, including stop means arranged in the path of movement of said ignition piston to limit the return movement thereof.

19. A pulsating liquid jet gun, as claimed in claim 18, wherein said free piston is of a size that its return movement is blocked by said ignition piston after said ignition piston applies against said stop means.

20. A pulsating liquid jet gun, as claimed in claim 19, wherein said ignition piston and said free piston are disposed coaxially in respect to each other.

21. A method of operating a liquid jet gun using a cylinder having interconnected large diameter, intermediate diameter and small diameter portions of different diameter dimensions with the smallest diameter portion having a nozzle discharge and with an ignition piston having respective portions movable in the large diameter portion and into and out of the intermediate diameter portion in sealing engagement therewith and with a free piston having respective portions movable in the intermediate diameter portion and into and out of the small diameter portions in sealing engagement therewith, comprising, periodically directing a propellant charge into the intermediate diameter portion between the free piston and the ignition piston, moving the free piston and ignition pistons relatively so as to cause the adiabatic compression of the propellant charge and the ignition thereof to force the free piston relatively away from said ignition piston, periodically filling the small diameter portion with a liquid so that the liquid becomes forced out by the movement of the free piston upon ignition of the propellant charge.

22. A method of operating a liquid jet gun, as claimed in claim 21, including directing a liquid into the intermediate diameter portion against the free piston to move it in a direction toward the ignition piston in order to compress the charge before it is ignited.

23. A method of operating a liquid jet gun, as claimed in claim 21, including directing fluid under pressure into the large diameter portion of the cylinder in order to act upon the ignition piston in a direction to return it to its initial position.

24. A method of operating a liquid jet gun, as claimed in claim 21, wherein the intermediate diameter portion of the piston is continuously subjected to pressure after the liquid has been forced out of the nozzle in order to return the free piston to an initial position.

25. A method of operating a liquid jet gun, as claimed in claim 24, wherein the fluid pressure comprises the liquid charge which is directed into the intermediate portion of said cylinder and communicating the intermediate portion of said cylinder with the liquid chamber so as to permit the liquid to flow from the intermediate diameter portion of said cylinder into said liquid chamber.

* * * * *